US007175212B2

(12) United States Patent
Cetnar et al.

(10) Patent No.: US 7,175,212 B2
(45) Date of Patent: Feb. 13, 2007

(54) LATCH HAVING RELEASABLE CINCHING MECHANISM

(75) Inventors: Roman Cetnar, Newmarket (CA); Ann-Margaret Mozola, Lakefield (CA); Kris Tomaszewski, Newmarket (CA)

(73) Assignee: Intier Automotive Closures Inc., Newmarket (CA)

( * ) Notice: Subject to any disclaimer, the term of this patent is extended or adjusted under 35 U.S.C. 154(b) by 0 days.

(21) Appl. No.: 10/505,669

(22) PCT Filed: Feb. 25, 2003

(86) PCT No.: PCT/CA03/00247

§ 371 (c)(1),
(2), (4) Date: Jan. 31, 2005

(87) PCT Pub. No.: WO03/071064

PCT Pub. Date: Aug. 28, 2003

(65) Prior Publication Data

US 2005/0121922 A1 Jun. 9, 2005

Related U.S. Application Data

(60) Provisional application No. 60/360,144, filed on Feb. 25, 2002.

(51) Int. Cl.
*E05C 3/16* (2006.01)

(52) U.S. Cl. ..... 292/216; 292/201; 49/280

(58) Field of Classification Search ..... 292/216, 292/215, 201, DIG. 4, DIG. 23; 49/280
See application file for complete search history.

(56) References Cited

U.S. PATENT DOCUMENTS 4,395,064 A * 7/1983 Bellot et al. ..... 292/201
4,843,849 A 7/1989 Kamke et al.
4,927,196 A 5/1990 Girard et al.
4,929,007 A 5/1990 Bartczak et al.
5,639,130 A * 6/1997 Rogers et al. ..... 292/216
5,918,917 A * 7/1999 Elton et al. ..... 292/201

(Continued)

FOREIGN PATENT DOCUMENTS

EP 0 745 746 4/1996

(Continued)

*Primary Examiner*—Brian E. Glessner
*Assistant Examiner*—Mark Williams
(74) *Attorney, Agent, or Firm*—Clark Hill PLC

(57) ABSTRACT

A vehicle latch has a housing and a ratchet pivotally mounted to the housing. The ratchet is operable to move between an unlatched position, a secondary latched position, and a primary latched position. A release lever is pivotally mounted to the housing and operatively connects to the ratchet for unlatching the ratchet from either of the secondary or primary latched positions. The operative connection has a guide pin. A cinching lever has a cam surface that slidingly engages the guide pin. The cam surface defines a predetermined path of travel as the cinching lever is drivingly reciprocated in a cinching cycle. The predetermined path enables the cinching lever to be initially out of the path of travel of the ratchet, to engage the ratchet when the ratchet is in the secondary position and drivingly rotating the ratchet to the primary latched position, and thereafter move out of the path of travel of the ratchet. The guide pin moves to urge the cinching lever out of the predetermined path when the release lever is operated in unlatching the latch.

6 Claims, 5 Drawing Sheets

U.S. PATENT DOCUMENTS

| | | | | |
|---|---|---|---|---|
| 6,123,372 | A * | 9/2000 | Rogers et al. | 292/216 |
| 6,125,583 | A | 10/2000 | Murray et al. | |
| 6,213,525 | B1 * | 4/2001 | Nicola | 292/223 |
| 6,254,148 | B1 * | 7/2001 | Cetnar | 292/201 |
| 6,341,448 | B1 * | 1/2002 | Murray et al. | 49/280 |
| 6,540,271 | B1 * | 4/2003 | Kalsi | 292/216 |
| 6,550,825 | B2 * | 4/2003 | Ostrowski et al. | 292/199 |
| 6,637,783 | B2 * | 10/2003 | Takamura | 292/201 |
| 6,666,483 | B2 * | 12/2003 | Baniak et al. | 292/123 |
| 6,695,360 | B1 * | 2/2004 | Forsell et al. | 292/216 |
| 6,698,804 | B2 * | 3/2004 | Shiota et al. | 292/201 |
| 6,764,113 | B1 * | 7/2004 | Cetnar | 292/201 |

FOREIGN PATENT DOCUMENTS

| | | |
|---|---|---|
| FR | 2 630 773 | 4/1988 |

* cited by examiner

LATCH HAVING RELEASABLE CINCHING MECHANISM

RELATED APPLICATION

This patent application is a §371 of PCT/CA03/00247, filed on Feb. 25, 2003, which claims priority to and all the benefits of U.S. Provisional Patent Application No. 60/360,144, filed on Feb. 25, 2002.

FIELD OF THE INVENTION

This invention relates to a vehicle latch that has power cinching mechanism that is releasable in the event of a power failure.

BACKGROUND OF THE INVENTION

Vehicle latches generally comprise a housing, a ratchet, a pawl, an inside release lever, an outside release lever, an inside locking lever, and an outside locking lever. The various levers are operably coupled to the pawl to effect the various functions of the latch. Examples of typical latches are disclosed in U.S. Pat. Nos. 4,929,007 and 6,254,148.

In U.S. Pat. No. 6,125,583, there is disclosed a power operated latch that can be actuated to cinch the latch closed from the secondary closed position to the primary closed position. Other cinching latches are available on the Chrysler™ minivan optionally fitted with a power sliding door.

One disadvantage of the prior art cinching latches is in the event of a power failure after the latch has commenced its cinching cycle. The cinching mechanism is engaged with the ratchet during cinching. If power is lost, the cinching mechanism remains engaged with the ratchet and may prevent the ratchet from counter rotating and unlatching.

SUMMARY OF THE INVENTION

The disadvantages of the prior art may be overcome by providing a latch with a cinching mechanism that automatically disengages upon a manual unlatching operation.

According to one aspect of the invention, there is provided a vehicle latch having a housing and a ratchet pivotally mounted to the housing. The ratchet is operable to move between an unlatched position, a secondary latched position, and a primary latched position. A release lever is pivotally mounted to the housing and operatively connects to the ratchet for unlatching the ratchet from either of the secondary or primary latched positions. The operative connection has a guide portion, such as a pin. A cinching lever has a cam surface that slidingly engaging the guide portion. The cam surface defines a predetermined path of travel as the cinching lever is drivingly reciprocated in a cinching cycle. In the preferred embodiment, the predetermined path enables the cinching lever to be initially out of the path of travel of the ratchet, to engage the ratchet when the ratchet is in the secondary position and drivingly rotating the ratchet to the primary latched position, and thereafter move out of the path of travel of the ratchet. When the release lever is operated to unlatch the latch, the guide portion moves to urge the cinching lever out of the predetermined path. Thus, even if an actuator driving the cinching lever were to be disabled by a power failure or a jam occurs, the cinching lever 22 will automatically be urged out of engagement with the ratchet upon manual operation of the release lever.

BRIEF DESCRIPTION OF THE DRAWINGS

In drawing that illustrate embodiments of the present invention.

DETAILED DESCRIPTION OF THE INVENTION

Figure 1:
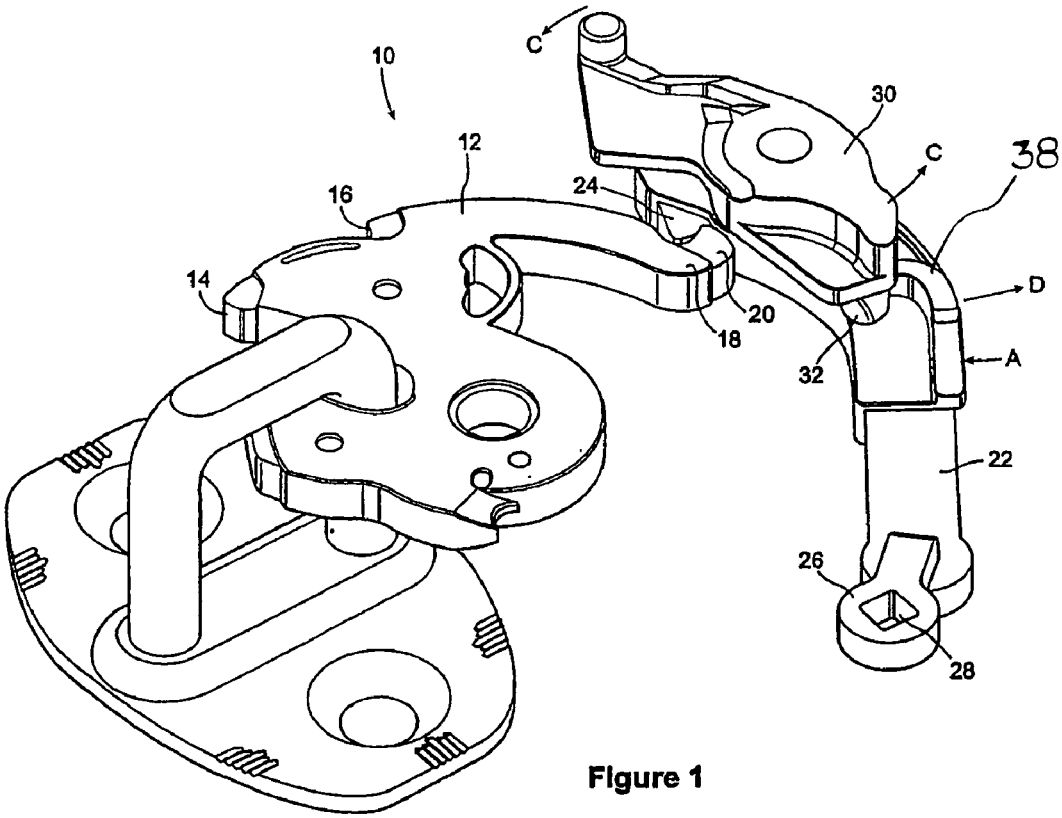
FIG. 1 is a perspective view of components of a latch and cinching mechanism of the present invention.

FIG. 1 illustrates a latch of the present invention. The latch 10 is generally of conventional construction and design, generally comprising a ratchet 12 rotatably mounted to a housing (not illustrated). Ratchet 12 rotates between unlatched, secondary latched and a primary latched positions, and biased to the unlatched position. As is conventional, ratchet has a primary detent 14 and a secondary detent 16. Ratchet 12 has an arcuately extending arm 18 with a hook 20 at its distal end.

A pawl (not illustrated) is rotatably mounted to the housing and positioned to engage primary detent 14 and secondary detent 16 to retain the ratchet 12 in the primary and secondary latched positions respectively. The pawl is biased to continuously engage the ratchet 12.

The latch 10 has a cinching lever 22 slidably mounted within the housing of the latch. A spring (not shown) applies a biasing force A against one side of lever 22 urging the lever 22 towards the ratchet 12. Lever 22 is preferably arcuate having a hook 24 at one end. The opposite end has a link 26 pivotally connected thereto.

Link 26 has an aperture 28 for receiving a driving engagement from an actuator (not illustrated) to provide driving rotation of the link 26.

Figure 2:
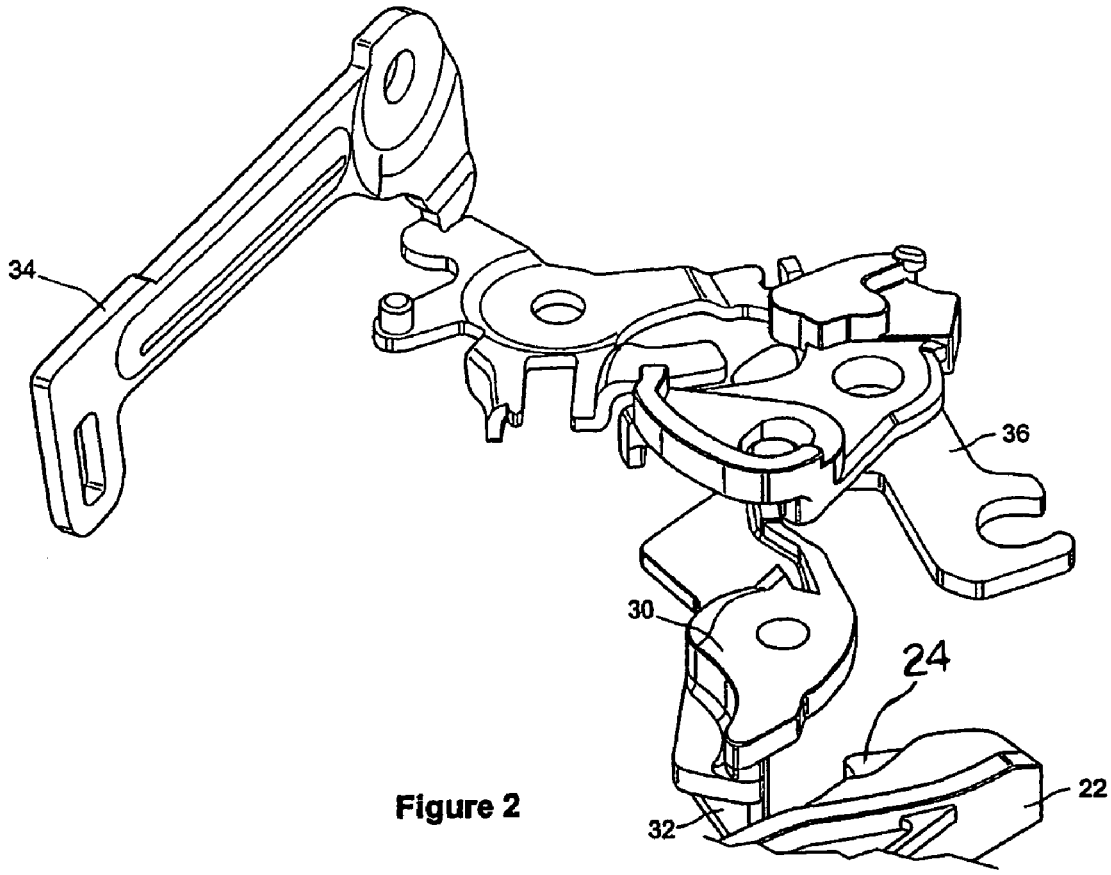
FIG. 2 is perspective view of the releasing components of the latch of FIG. 1.

The latch is further provided with an intermediate lever 30 that is pivotally mounted within the housing. The intermediate lever 30 provides an operative connection between the release levers 34, 36 and the pawl as illustrated in FIG. 2. The underside of the lever 30 has a guide pin 32.

Figure 3:
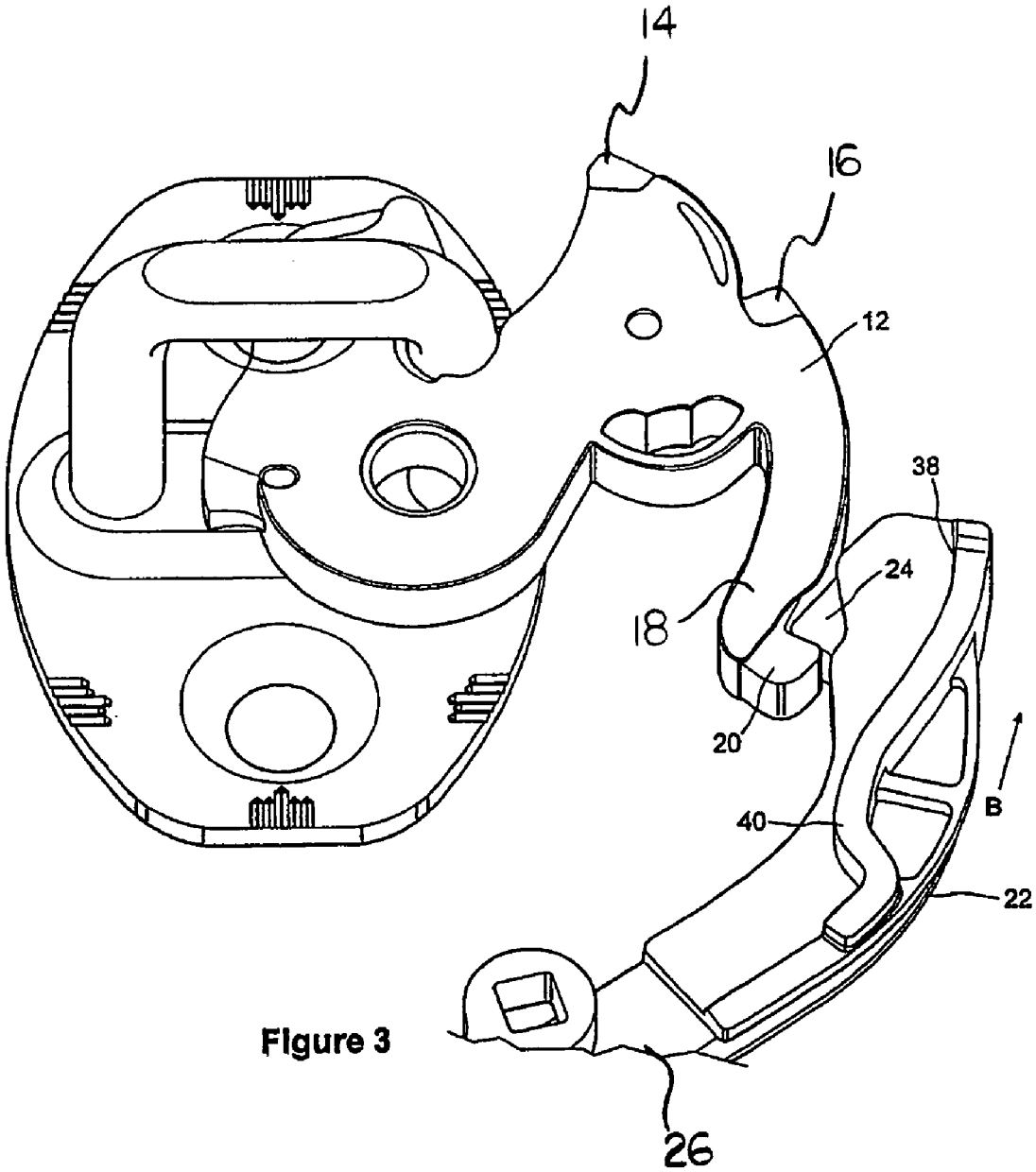
FIG. 3 is a perspective view of the cinching lever of the latch of FIG. 1, with the cinching lever engaged with the ratchet.

Referring to FIGS. 1 & 3, the lever 22 is illustrated engaging the ratchet 12. Lever 22 has a cam surface 38 (seen best in FIG. 3), along which the guide pin 32 travels in a predetermined path. The biasing force A urges the cam surface 38 against the guide pin 32 and thus, the cam surface defines a path of the travel of the lever 22 and in particular of the hook 24. The arm 18 and the cam surface 38 are sized and configured such that the hook 24 will not interfere with the travel of the ratchet 12. As the link 26 is rotated from a start or rest position, the lever 22 will travel relative to guide pin 32 in direction of arrow B (FIG. 3). The guide pin 32 will encounter turn 40 which will allow lever 22 to move towards the ratchet 12. If and only if the ratchet 12 is in the secondary latched position, hook 24 will engage hook 20. Further driving rotation of link 26 will cause the lever 22 to move is a direction opposite to arrow B and responsively rotate ratchet 12 from the secondary position to the primary position. As the link 26 rotates once the ratchet 12 engages the pawl to be secured in the primary position, the lever 22 will pivot, moving the hook 24 away from the ratchet and out of engagement with hook 20.

Figure 4:
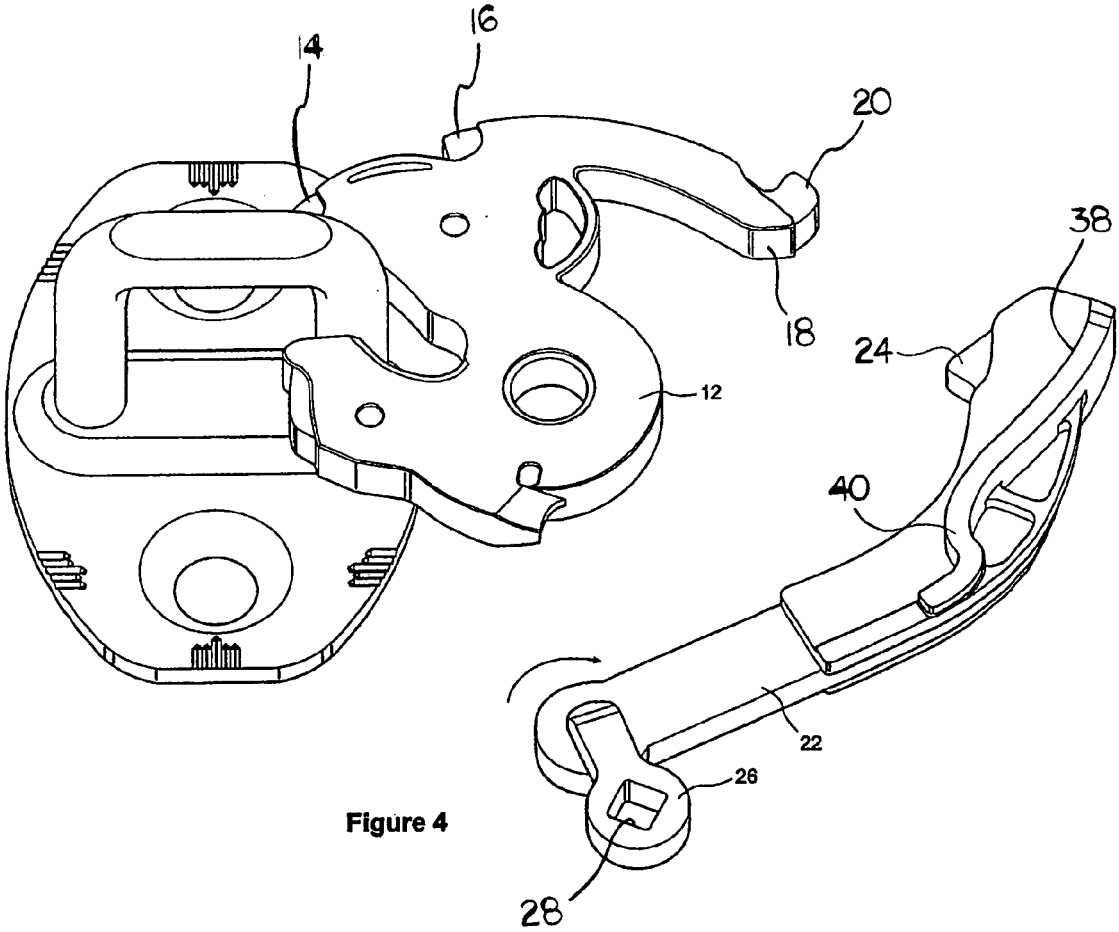
FIG. 4 is a perspective view of the cinching mechanism of the latch of FIG. 1 commencing a cinching cycle.
Figure 5:
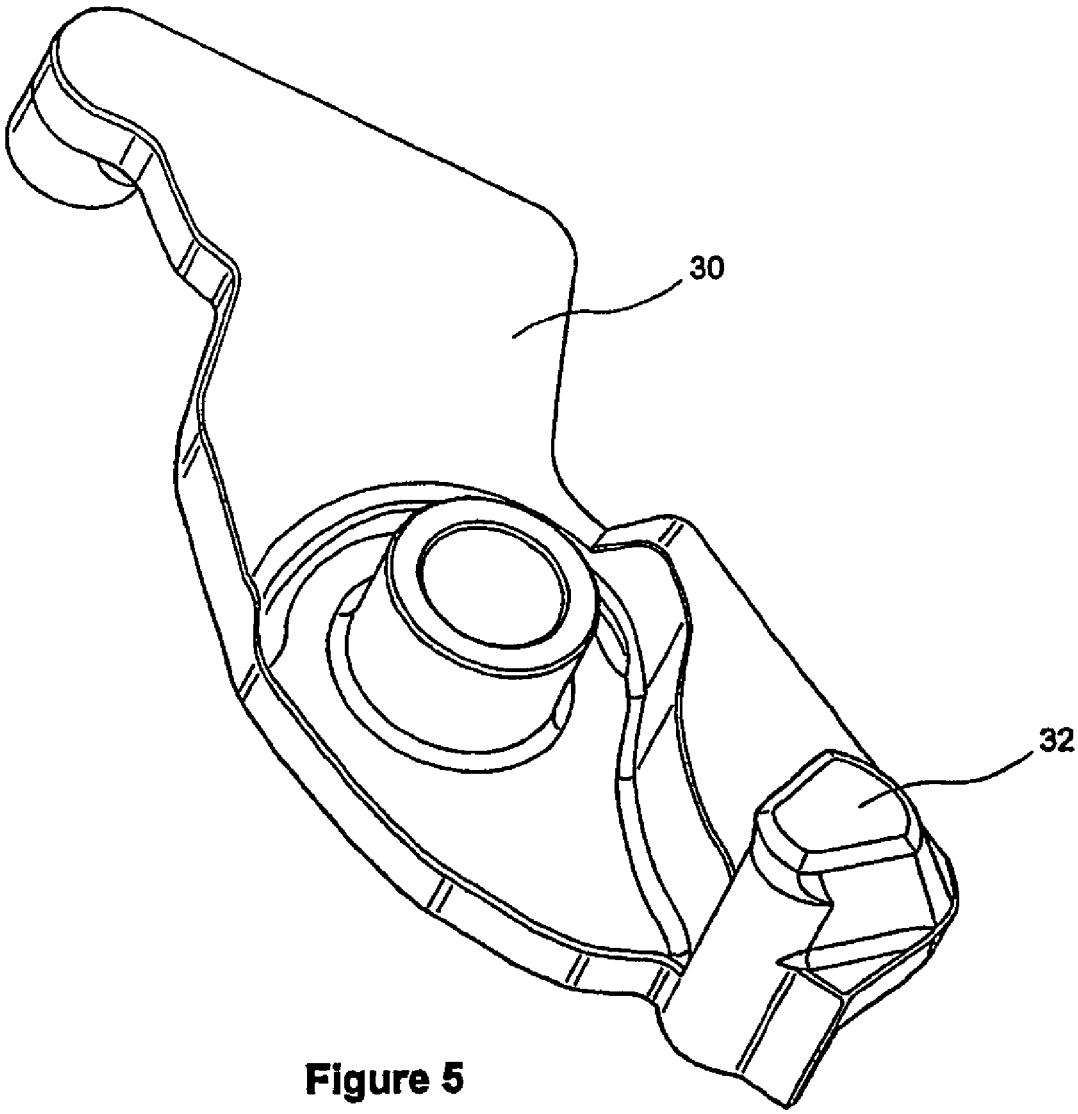
FIG. 5 is a perspective view of the underside of the intermediate lever of the latch of FIG. 1.

One full rotation of the link 26 is required to complete the cinching operation. In the preferred embodiment, the link 26 will be at a right angle from the lever 22 as illustrated in FIG. 4 when in the rest position. The link 26 will rotate in the clockwise direction in completing a cinching cycle.

Referring back to FIG. 1, the failsafe feature of the present invention is illustrated. The lever 30 rotates about its axis in an unlatching direction C. The rotation will responsively rotate the pawl to rotate and release the ratchet allowing the ratchet 12 to counter rotate to the unlatched position. The lever 30 also rotates the guide pin 32 away from the ratchet 12 and responsively urges the cinching lever 22 outwardly away from the ratchet 12 is direction D and out of the predetermined path. Thus, if rotation of the link 26 were to be disabled by a power failure or a jam, the cinching lever 22 will automatically be urged outwardly upon operation of either of the release levers 34, 36.

The preferred embodiment of the present invention has been illustrated. The shape of many of the components of the latch are dictated by the available space within and the geometry of the latch and the available volume within the door in which the latch is to be installed. Thus, it is apparent to those skilled in the art of vehicle latch design that the shaping of the components may be altered without departing from the scope of the present invention.

In particular, the present invention has been illustrated with the guide pin 32 mounted on an intermediate lever 30. The guide pin 32 could be mounted on any of the various levers operatively connecting a release lever to the pawl. Further, the guide pin 32 could be mounted on the pawl itself, depending on the particular geometry of the latch.

Although various preferred embodiments of the present invention have been described in detail, it will be appreciated by those skilled in the art that variations may be made without departing from the scope of the invention as defined by the appended claims.

The invention claimed is:

1. A vehicle latch comprising:

a) a housing, b) a ratchet pivotally mounted to the housing and operable to move between an unlatched position, a secondary latched position, and a primary latched position, c) a release lever pivotally mounted to the housing and operatively connected to the ratchet for unlatching from either of the secondary or primary latched positions, said operative connection having a guide portion, d) a cinching lever operably mounted in the housing, said cinching lever having a cam surface, said cam surface slidingly engaging said guide portion, said cam surface defining a predetermined path of travel for the cinching lever as it is drivingly reciprocated in a cinching cycle to move the ratchet to the primary latched position, wherein said guide portion is moveable to engage and force the cinching lever out of the predetermined path when the release lever is operated to unlatch the latch; and wherein said predetermined path enables said cinching lever to be initially out of the path of travel of said ratchet, to engage said ratchet when said ratchet is in the secondary position and drivingly rotate said ratchet to said primary latched position, and thereafter move out of the path of travel of the ratchet.

2. A vehicle latch according to claim 1, wherein said guide portion is a pin.

3. A vehicle latch according to claim 1, wherein said cinching lever is biased to engage said ratchet.

4. A vehicle latch according to claim 1, wherein said operative connection is an intermediate lever kinematically coupled to said release lever.

5. A vehicle latch according to claim 4, including a second release lever operatively connected to said intermediate lever.

6. A vehicle latch according to claim 1, wherein said cinching lever is controlled by a power actuator.

* * * * *